United States Patent [19]

Dahlgren

[11] 4,237,785

[45] Dec. 9, 1980

[54] INKER FOR APPLYING NEWSPRINT TYPE INK

[76] Inventor: Harold F. Dahlgren, 3305 Manor Way, Dallas, Tex. 75235

[21] Appl. No.: 897,262

[22] Filed: Apr. 18, 1978

[51] Int. Cl.[3] ..... B41F 7/26; B41F 7/36; B41F 31/06; B41F 31/36

[52] U.S. Cl. ..... 101/141; 101/148; 101/350; 101/352; 101/363; 101/426

[58] Field of Search ..... 101/363, 350, 148, 348, 101/141, 148, 426, 206–209, 351, 352; 118/258, 259, 262

[56] References Cited

U.S. PATENT DOCUMENTS

| | | | |
|---|---|---|---|
| 3,283,712 | 11/1966 | Chambon | 101/350 |
| 3,508,489 | 4/1970 | Norton | 101/148 |
| 3,585,932 | 6/1971 | Granger | 101/350 |
| 3,587,460 | 6/1971 | Chambon | 101/350 X |
| 3,673,959 | 7/1972 | Jezuit et al. | 101/148 |
| 3,785,285 | 1/1974 | Chambon | 101/350 |
| 3,926,114 | 12/1975 | Matuschke | 101/148 X |
| 3,937,141 | 2/1976 | Dahlgren | 101/148 |
| 3,986,452 | 10/1976 | Dahlgren | 101/148 |
| 4,127,067 | 11/1978 | Dahlgren et al. | 101/148 X |

*Primary Examiner*—J. Reed Fisher
*Attorney, Agent, or Firm*—Gerald G. Crutsinger; John F. Booth; Harry C. Post, III

[57] ABSTRACT

A method and apparatus for applying a thin film of newsprint ink to a printing plate, the apparatus comprising a metering roller in rolling pressure indented relation with a transfer roller having an oleophillic surface. The transfer roller is in pressure indented relationship with a form roller which transfers a thin film of ink to the printing plate. An excess of ink is supplied to the nip between the metering roller and the transfer roller to produce the thin film of ink which may be further conditioned by an ink storage roller prior to entry of the film of ink into the ink transfer nip between the transfer roller and the form roller. By controlling the relative speeds between the form roller and the transfer roller, slippage occurs which meters a thin film of ink onto the form roller for transfer and application to the printing plate. A material conditioning roller is in rolling contact with the form roller to produce a matte finish on the newly formed film of ink and smooth same to render the film of ink conditioned for application to the printing form.

11 Claims, 3 Drawing Figures

INKER FOR APPLYING NEWSPRINT TYPE INK

BACKGROUND OF THE INVENTION

Inkers for printing plates which have achieved commercial acceptance generally comprise from two to four form rollers which are positioned in rolling engagement with a printing plate. Each of the form rollers is usually in rolling engagement with one or more vibrator rollers to which ink is applied by a multitude of rollers in a train of rollers of varying diameters arranged in pyramid fashion. Ink is delivered to the train of rollers over a ductor roller which oscillates into and out of engagement with a film of ink formed by a flexible doctor blade urged into engagement with the hard surface of an ink fountain roller by a multiplicity of ink keys.

The ink film formed on the ink fountain roller has been too thick and too irregular for application directly to a printing plate for quality printing. These inkers which include a multiplicity of rollers are intended to reduce the thickness of the ink film and to deliver a film of uniform thickness to the printing plate. However, since the ink film on each of the rollers is not totally replenished on each revolution of the form roller; image ghosting and ink accumulation and starvation is not completely eliminated. Thus, stripes and uneven ink distribution are produced on the product due to the ghosting and ink accumulation.

The multiple roller inkers require complex drive trains and are relatively expensive to purchase initially and to maintain thereafter.

Other types of inkers which have attempted to meter ink from a transfer roller to a form roller have utilized a doctor blade to remove all of the film of feedback ink from the form roller prior to replenishing the ink film. Since most form rollers are resilient, the contact of the doctor blade to the form roller surface scores the form roller and wears out the blade and roller causing an uneven film of ink.

The invention described herein addresses the problem of forming a thin film of newsprint type printing ink of low viscosity having substantially uniform thickness on a form roller and moving the film of ink into engagement with the image area on the printing plate while eliminating the trains of rollers in the inking system, eliminating the necessity for the consumption of excessive power and further reducing and eliminating numerous adjustments and areas of ghosting and ink accumulation which produce undesirable variations on the product being printed.

Devices of the type disclosed in U.S. Pat. No. 3,926,114 were devised to remove all the unused portion of ink and dampening fluid from the form roller prior to forming a new film of ink by metering the ink through a gap between the form roller and a transfer roller. There is considerable wear on the ink removal blade and the roller in this type of device. Also, it is extremely difficult to form an ink film which is sufficiently thin by using a doctor blade when metering newprint ink.

Inking devices of the type disclosed in U.S. Pat. No. 2,240,762 employ rollers having cavities formed in the surface to meter ink onto a form roller for application to a printing plate.

SUMMARY OF THE INVENTION

The improved inker construction comprises a metering roller and a transfer roller, each having an oleophillic surface urged into pressure indented relationship. The metering roller is adapted to meter an excess of low viscosity ink at the nip between the metering roller and the transfer roller such that a uniform film is metered onto the surface of the transfer roller. An ink storage roller is positioned in pressure indented relation with the transfer roller to further condition the film of ink to assure that the film is substantially uniform and continuous. The film of ink is then sheared and metered between the nip between the transfer roller and a form roller. By controlling the speed between the form roller and the transfer roller, slippage occurs thus forming a thin, substantially uniform, calendared, smooth layer of ink onto the form roller.

As an irregular film of ink moves from the printing plate on the form roller, it marries with a fresh uniform film of ink on the transfer roller to form a substantially uniform film of ink on the form roller by removing ink from the transfer roller to replenish the depleted areas on the form roller. The transfer roller continuously furnishes a uniform film of ink to the form roller and the irregular feedback film, formed as the form roller removes ink from the transfer roller, moves back to the flooded nip between the transfer roller and metering roller to be remetered.

The film of ink on the form roller is further conditioned by a material conditioning roller to produce a smooth matte finish thereon. The material conditioning roller has essentially the same affinity for ink as does the form roller and thus splits the film causing a matte finish on the ink layer.

The matte finish is readily adapted to accepting dampening fluid for use in a lithographic printing system. A dampening system having a transfer roller with a hydrophillic surface and a metering roller transfers dampening fluid to the matte finish of the ink on the form roller prior to movement of the ink and dampening fluid layer into engagement with the printing plate. The ink and water film is transferred to image areas on the printing plate and the dampening fluid to non-image areas such that lithographic printing may be performed.

After the layer of ink on the form roll moves away from the printing plate there will be ghosted or depleted areas of ink which are reduced by an ink storage roller which accumulates the ink and supplies it to the ghosted or areas starved of ink prior to the layer of ink moving into the nip between the form roller and the transfer roller to replenish the depleted film of ink.

This type of inker is particularly adapted for applying newsprint type ink in inking processes such as Di-Litho (registered trademark of American Newspaper Publishers Association/Research Institute) for printing direct on a lithographic plate with water, printing offset from a blanket with water, letterpress stereotype, dry offset, and letterpress direct printing with a letterpress plastic relief plate.

A primary object of the invention is to provide an inker to continuously provide a substantially uniform thickness of ink to a form roller for applying to a lithographic printing system.

A still further object of the invention is to provide an inking system which affords precision control of the thickness of the ink film to eliminate ghosting and a resulting color variation of printed images.

Another object of the invention is to afford an inking system to use with low viscous ink which will provide a substantially uniform thickness of ink which is readily acceptable to receiving dampening fluid for application on a printing plate.

A further object of the invention is to provide a simple and efficient inking system capable of forming a thin, continuous and substantially uniform thickness of ink which eliminates the necessity of power consuming techniques.

A still further object of the invention is to provide inking apparatus which has a single point of control of the thickness of ink which eliminates streaks and imperfections from lint and paper fragments while minimizing lag time of adjusting the ink film.

A still further object of the invention is to provide an inking system and a dampening system, each being particularly adapted to prevent accumulation of ink and dampening fluid in the inking system and to prevent misting of ink.

Other and further objects will become apparent upon referring to the following detailed description and the attached drawings.

BRIEF DESCRIPTION OF THE DRAWINGS

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
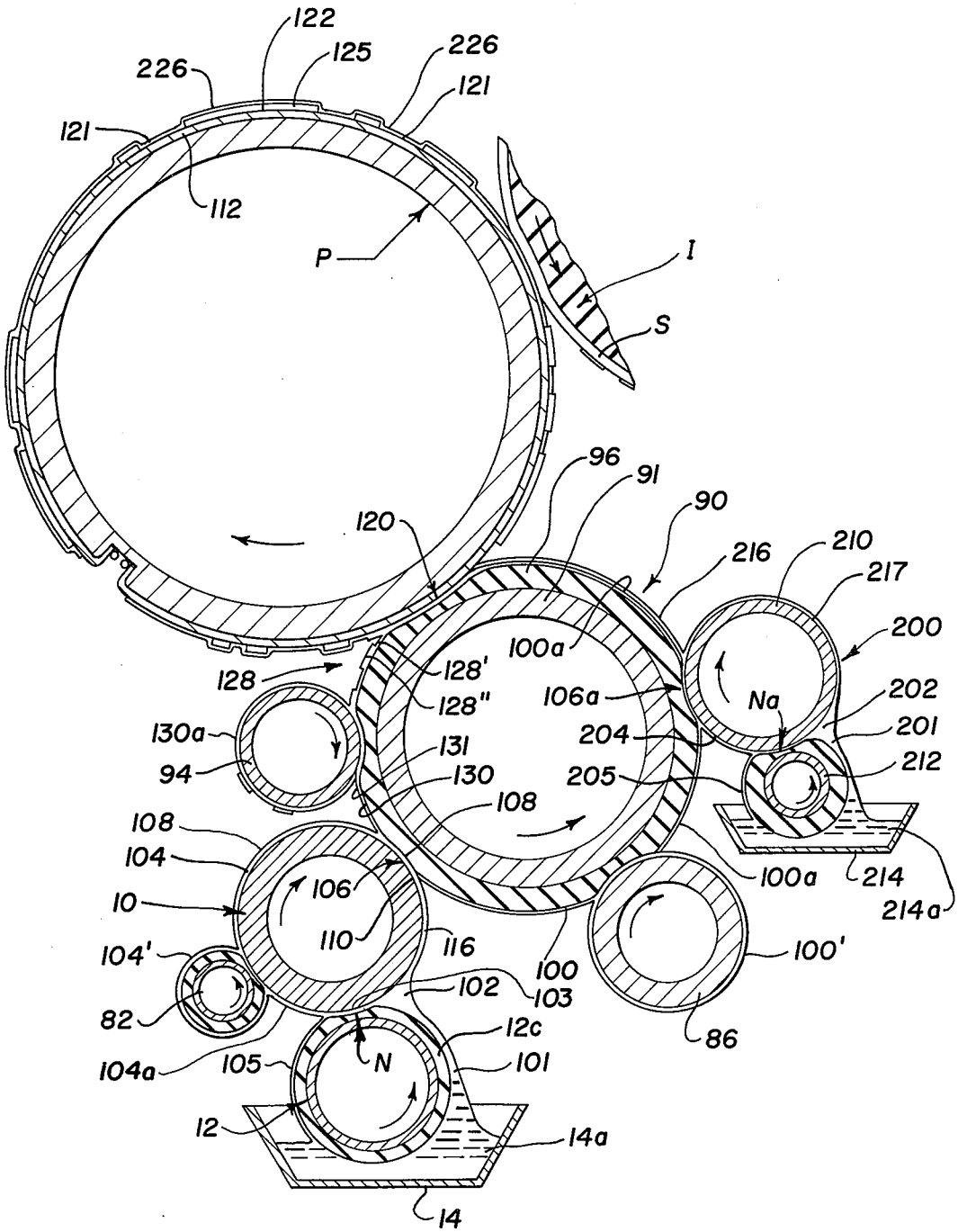
FIG. 1 is a diagrammatic illustration of the inking system illustrating the various films of ink and dampening fluid.

In FIG. 1 of the drawing, the numeral 1 generally designates an ink applicator apparatus for applying ink and dampening fluid to a lithographic printing plate of a printing press. The water applicator is a dampener 200 of the type disclosed in U.S. Pat. No. 3,937,141, entitled "Dampener For Lithographic Printing Plates" which issued Feb. 10, 1976 to Harold P. Dahlgren. The disclosure of U.S. Pat. No. 3,937,141 is incorporated herein by reference in its entirety for all purposes.

Figure 2:
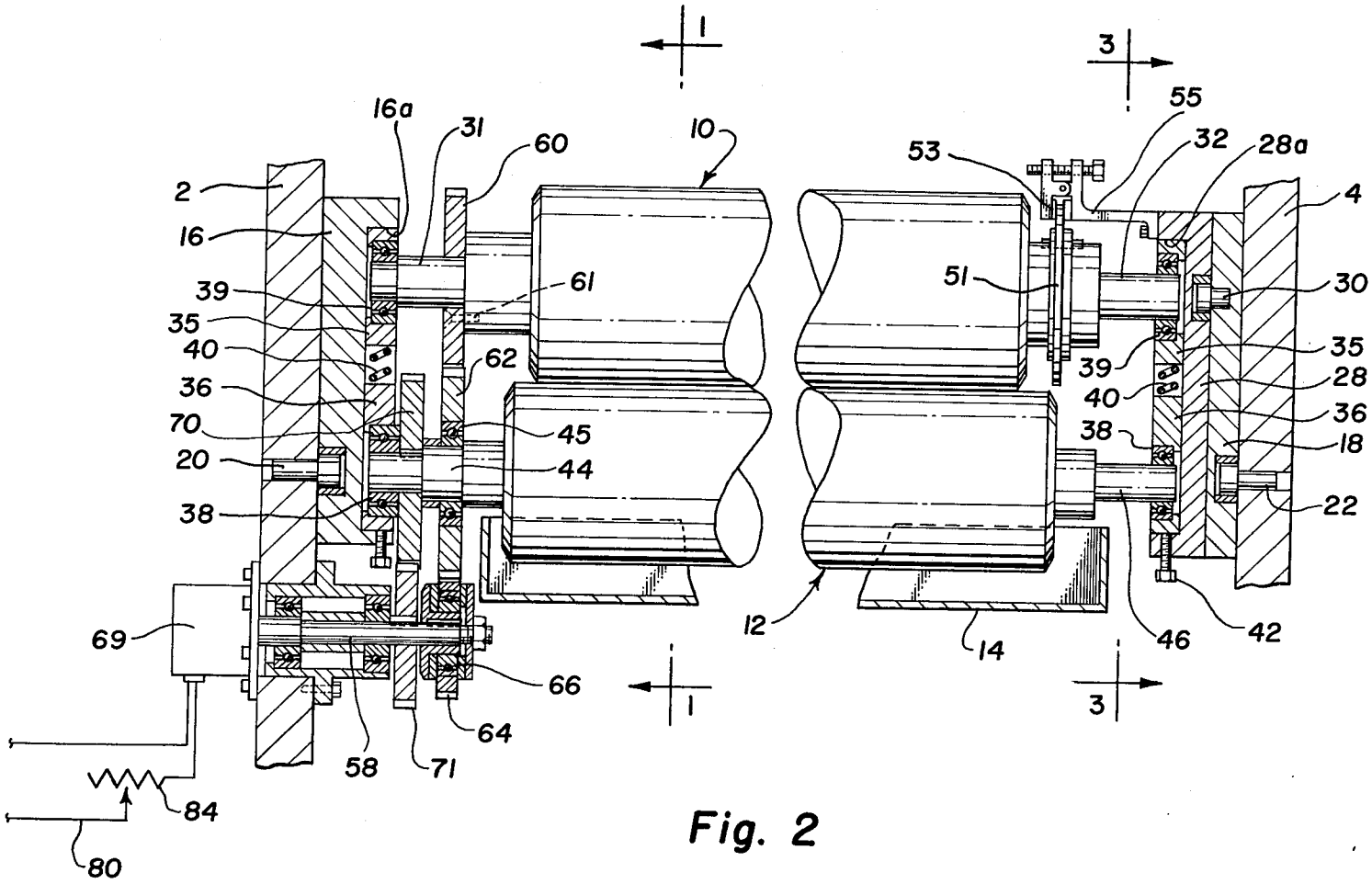
FIG. 2 is a front elevational view illustrating the metering and transfer rollers and support structure.

As best illustrated in FIG. 2, ink applicator 1 comprises spaced side frames 2 and 4 joined by tie bars (not shown) forming a strong rigid structure for supporting form roller 90, ink transfer roller 10, ink metering roller 12 and ink pan 14. Side frames 2 and 4 may be the side frames of a press or may comprise inker side frames connectable to side frames of a printing press.

Throw-off links 16 and 18 are pivotally secured by stub shafts 20 and 22 to the respective side frames 2 and 4. Throw-off cylinders 24 and 26 are pivotally connected between side frames 2 and 4 and throw-off links 16 and 18, respectively, for pivoting throw-off links 16 and 18 about stub shafts 20 and 22 for moving transfer cylinder 10 into position, as will be hereinafter more fully explained, for delivering ink to a form roll in a lithographic printing system.

A skew arm 28 is mounted for pivotal movement of one end of a metering roller 12 about the axis of ink transfer roller 10. As diagrammatically illustrated in FIG. 2, skew arm 28 is rotatably secured to stub shaft 30 extending between link 18 and skew arm 28 adjacent an end of ink transfer roller 10.

Skew arm 28 and throw-off link 16 have grooves 28*a* and 16*a*, respectively, formed in the inner surfaces thereof in which blocks 36, carrying self-aligning bearings 38, are slidably disposed. Blocks 35 are rigidly secured in the upper portion of grooves 28*a* and 16*a* by screws 37 to provide suitable support for shafts 31 and 32 of the ink transfer roller 10. Suitable means such as resilient springs 40 between blocks 35 and 36 urge blocks 36 longitudinally of skew arm 28 and throw-off link 16 in a direction away from the longitudinal axis of transfer roller 10. A pressure adjustment screw 42 urges block 36 longitudinally of skew arm 28 and throw-off link 16 against the bias of springs 40. Stub shafts 44 and 46, extending outwardly from opposite ends of metering roller 12, are received in self-aligning bearings 38 to rotatably secure metering roller 12 in pressure indented relation with transfer roller 10. Stub shafts 31 and 32, extending outwardly from opposite ends of transfer roller 10, are received in bearings 39 in blocks 35.

It should be readily apparent that rotation of pressure adjustment screws 42 will move opposite ends of metering roller 12 relative to the axis of transfer roller 10 for controlling pressure between transfer roller 10 and metering roller 12.

Figure 3:
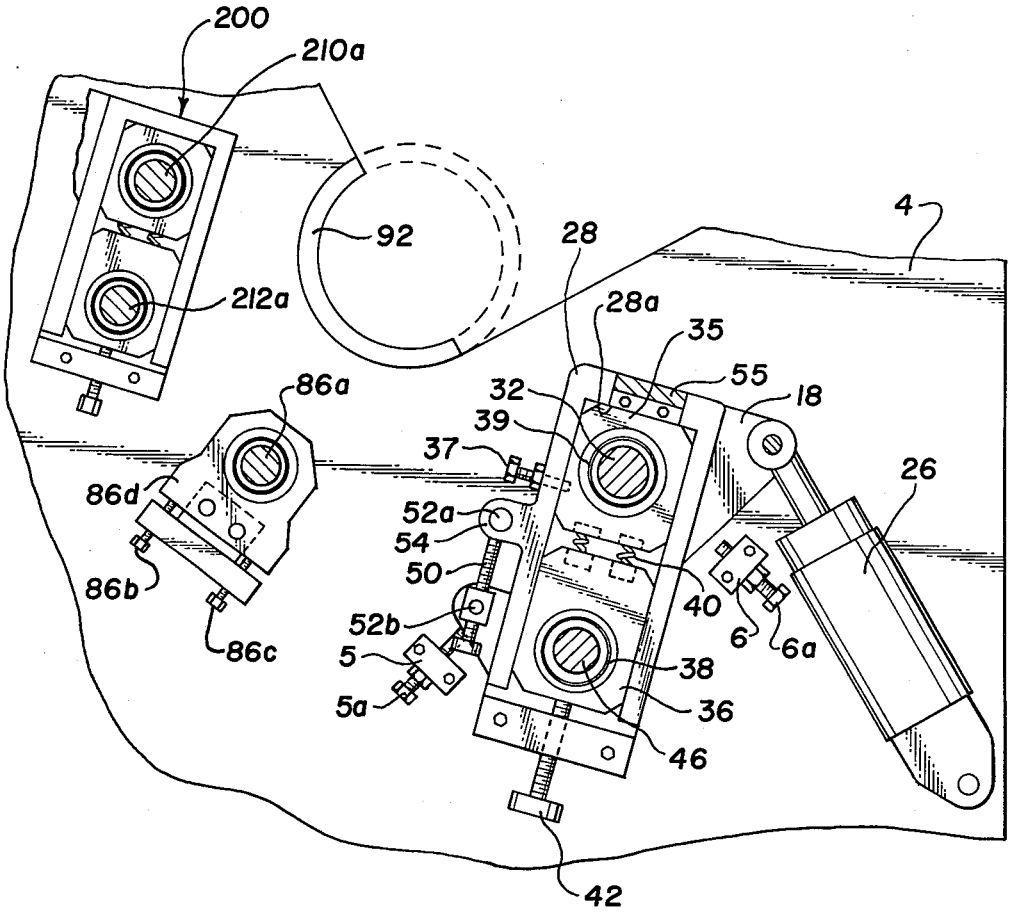
FIG. 3 is a cross sectional view taken along line 3—3 of FIG. 2.

As illustrated in FIG. 3, suitable means is provided for establishing and maintaining a desired angular relationship between throw-off link 18 and skew arm 28. In the form of the invention illustrated in FIG. 3, an adjusting screw 50 is rotatably secured to skew arm 28 and extends through threaded apertures in pivotal blocks 52*a* and 52*b*. Blocks 52*a* and 52*b* are pivotally secured to lug 54 on arm 28 and lug 56 on link 18. By adjusting screw 50, the spacing between lugs 54 and 56 is adjusted to move skew arm 28 relative to link 18 about shaft 30.

Side frames 2 and 4 have suitable adjustable stop means such as stop blocks 5 having set screws 5*a* extending therethrough for engaging throw-off links 16 and 18 when rods of throw-off cylinders 24 and 26 are extended for establishing a desired pressure relationship between the transfer cylinder 10 and an ink coated form roller 90 arranged to transfer ink to a lithographic or relief printing plate 112 on plate cylinder P, as will be hereinafter more fully explained. Stop means such as stop blocks 6 having set screws 6*a* secured thereto provide an off-impression limit when piston rods of throw-off cylinders 24 and 26 are retracted to move the transfer roller 10 away from the surface of form roller 90. Stub shaft 32 has a brake disc 51 secured thereto and friction pads 53 are pivotally secured to support 55 secured to arm 28 to control the speed of transfer roller 10 when it is driven by frictional engagement with form roller 90.

Stub-shaft 31, extending outwardly from the end of transfer roller 10, has a gear 60 rigidly secured thereto by screw 61 which is in meshing relation with a gear 62 rotatably secured by a bearing 45 disposed on shaft 44.

Gear 62 is secured in meshing relation with gear 64 on shaft 58 rotatably secured to side frame 2 through a clutch assembly 66 of a type such as a Morse one-way clutch. Shaft 58 is secured to the shaft of a variable speed drive means such as a variable speed electric gear-motor 69. It should be appreciated that gear-motor 69 may be replaced by other drive means such as gears, sprockets, or pulleys arranged to be driven from the printing press drive, preferably through a gear box or similar variable speed control apparatus.

Shaft 44, extending outwardly from the end of metering roller 12, has a gear 70 secured thereto in meshing relation with a gear 71 secured to and driven by shaft 58.

Power supply line 80 is connected through a variable rheostat 84 to the terminals of motor 69 so that motor may be run at variable speeds to control the speed of rotation, and, consequently, surface speeds of transfer roller 10 and metering roller 12 independently of the press drive. If it is deemed expedient to do so motor 69 could be replaced by a speed-variable coupling which connects shaft 58 to the press drive means, as hereinbefore described.

Clutch assembly 66 allows transfer roller 10 to be driven by gear-motor 69 at a minimum speed ratio relative to metering roller 12, for example 1:1, and allows transfer roller 10 to be over-driven by form roller 90 at higher speeds without driving the metering roller 12 at a faster speed which may tend to sling ink 14*a* out of pan 14.

It should be appreciated that clutch 66 can be deleted to allow drive of the transfer roller 10 positively from the gear-motor 69.

An ink storage roller 82, illustrated in FIG. 1, is preferrably a vibrator roller. Ink storage roller 82 is adapted to equalize areas of excess ink on transfer roller 10 in a manner to be more fully explained hereinafter.

Suitable means is provided for delivering an abundant supply of ink to the ink metering nip N between adjacent surfaces of transfer roller 10 and metering roller 12. In the particular embodiment of the invention illustrated in FIG. 1, a portion of the surface of metering roller 12 is submerged in ink 14*a* in ink pan 14.

Ink 14*a* preferrably comprises a low viscosity ink such as the type employed for inking raised image areas in letter press printing or the type used in direct or offset lithographic printing such as type ink.

The transfer roller 10 is preferably hard and has an exterior surface which may be smooth or textured and which is ink receptive or oleophillic. Ink transfer roller 10 may, therefore, have an exterior surface of materials such as copper, or plastic. The surface of transfer roller 10 may be either hard or resilient, depending upon the characteristics of the surface of form roller 90. If form roller 90 has a hard surface, the surface of transfer roller 10 is preferably soft. If form roller 90 has a resilient surface, the surface of transfer roller 90 is preferably hard.

Metering roller 12 preferably comprises a hollow tubular sleeve having stub shafts 44 and 46 formed thereon. A resilient cover 12*c* is secured about the outer surface of the sleeve. The material of metering roller 12 is selected so as to be oleophillic and the surface may be smooth or textured.

To reduce the tendency of ink to accumulate adjacent the ends of transfer roller 10, metering roller 12 is longer than transfer roller 10 such that ends of the metering roller 12 extend beyond the ends of transfer roller 10. The transfer roller 10 is preferably longer than form roller 90 to minimize accumulation of excess ink adjacent ends of form roller 90.

It should be readily apparent that, if desired, the material of transfer roller 10 and metering roller 12 may be reversed such that metering roller 12 has a hard surface and transfer roller 10 has a resilient cover, or both could be resilient.

Form roller 90 is preferably cut to be the same length as the printing plate to also eliminate accumulation of excess ink which will tend to build on the form roll if longer than the printing plate.

Referring to FIG. 1 of the drawing, transfer roller 10 is preferably positioned in pressure indented relation with a form roller 90, having a metal tubular core 91 to the ends of which are secured stub shafts extending outwardly therefrom and rotatably journaled in bearings 92 carried by the side frames 2 and 4.

Form roller 90 has a smooth outer cover 96 which may be non-absorbent or absorbent, hard or soft, depending upon the nature and construction of printing plate 112.

In one embodiment, form roller 90 may have a resilient non-absorbent surface. Another embodiment of form roller 90 includes a resilient surface and has a molleton type cover which absorbs ink and will reject dampening fluid. However, if plate 112 has raised image areas and is constructed of resilient material, form roller 90 could be provided with a hard surface of, for example, copper or a hard thin plastic covering.

An ink storage roller 94, preferably a vibrator roller, is adapted to remove ink from areas 128" from ink film 128 on the surface of form roller 90 and add the ink to the depleted areas 128' thereby creating a more uniform film of ink on the surface of roller 90 moving from the nip 120 toward nip 108.

A material conditioning roller 86, preferably a vibrator roller, is rotatably supported on shaft 86*a* in blocks 86*d* and is adapted to condition and smooth the surface of ink film 100 to make the film more receptive to accepting dampening fluid. Screws 86*b* and 86*c* are adapted to urge blocks 86*d* and roller 86 into pressure indented relation with form roller 90. The surface of material conditioning roller 86 is preferably of similar material to that of form roller 90 such that the surface has the same affinity for ink as does the surface of form roller 90.

As the ink film 100 emerges from the nip 106 between form roller 90 and transfer roller 10, it is slick, and calendared. A slick film of ink is not particularly receptive to dampening fluid since the surface tension of the molecules of ink may reject the thin layer of dampening fluid to be applied by dampener 200. Material conditioning roller 86 will receive a portion of the film 100 of ink thus splitting the film 100 of ink and producing a film 100' on roller 86 thus leaving film 100*a* with a matte finish having microscopic indentations. The matte finish on film 100*a* will more readily accept the thin layer of dampening fluid due to molecular attraction which is now greater than the surface tension of the dampening fluid forming a film 217.

Material conditioning roller 86 and ink storage rollers 94 and 82 are preferably constructed of diameters such that as they rotate ink will be properly applied or extracted and redistributed on the surface of roller 90.

Vibrator rollers 82, 86 and 94 are preferably provided with drive means (not shown) to oscillate the rollers in a longitudinal direction. Suitable oscillator drive means is well known to persons skilled in the printing art and further description is not deemed necessary. Rotation is provided through friction contact with adjacent surfaces.

Dampener 200 is diagrammatically illustrated in FIG. 1 and comprises a hydrophillic transfer roller 210 on shaft 210*a* and a resilient metering roller 212 on shaft 212*a*, mounted in a similar manner to inker 1, as described in U.S. Pat. No. 3,937,141. Metering roller 212 meters dampening fluid 214*a* from pan 214 onto transfer roller 210 through flooded nip Na. Water film controlled by pressure between rollers 210 and 212 forms a thin layer of dampening fluid 204 which is metered through dampening fluid transfer nip 106*a* onto the matte finish of ink film 100*a* on the surface of form roller 90.

The operation and function of the apparatus hereinbefore described is as follows:

Pressure between ends of transfer roller 10 and metering roller 12 is adjusted by rotating pressure adjustment screws 42.

Since long rollers urged together in pressure relation tend to deflect or bend, pressure adjacent centers of such rollers is less than pressure adjacent ends thereof. Pressure longitudinally of rollers 10 and 12 is adjusted by rotating screw 50 and rotating skew arm 28 about the axis of transfer roller 10 to a position wherein a desired pressure distribution longitudinally of rollers 10 and 12 is obtained.

Adjustment screw 5*a* is positioned to engage throw-off links 16 and 18 for establishing a desired pressure between transfer roller 10 and form roller 90.

The surface speeds of rollers 10 and 12 are regulatable by manipulating rheostat 84 as has been hereinbefore explained.

Dampener 200 is adjusted in a similar manner as inker 1.

For the purpose of graphically illustrating the novel function and results of the process of the mechanism hereinbefore illustrated and described, a diagrammatic view of the metering roller 12, the transfer roller 10 and the form roller 90 is shown in FIG. 1. Ink and water films shown are exaggerated for clarity.

As shown in FIG. 1, metering roller 12, when employed to deliver ink to a printing plate 112, is preferably a resilient surfaced roller having a smooth surface 12*c* thereon and has the lower side thereof immersed in ink 14*a* in pan 14. The metering roller 12 is rotatably mounted in pressure indented relation with transfer roller 10, and the pressure between adjacent roller surfaces is adjusted by screw 42, as hereinbefore described, so that the surface of transfer roller 10 is actually impressed into the surface of roller 12 at ink metering nip N.

As the surface of roller 12 rotates toward the ink metering nip N between rollers 10 and 12, a relatively heavy layer 101 of ink is picked up and lifted on the surface of roller 12. At the point of tangency, or cusp area at the ink metering nip N, between the rollers 10 and 12, a bead 102 of ink is piled up forming an excess of ink. The greatness of the excess of ink forming bead 102 is regulated by virtue of the fact that excess of ink will fall back into the pan 14 by gravity, thus, virtually creating a waterfall, and by the surface speed of metering roller 12. The bead 102 becomes a reservoir from which ink is drawn by transfer roller 10. As rollers 10 and 12 rotate in pressure indented relation, a layer of ink is sheared and/or metered between adjacent surfaces of the two rollers separated by a thin lubricating layer of ink 103. Since the transfer roller 10 has a smooth, oleophillic surface thereon, a portion of the film 103 adheres to the surface of roller 10 to form a film 104*a*, the remaining portion 105 thereof being rotated back or fed back in the pan 14. The film of ink 104*a* is distributed on the surface of roller 10 by reason of the rotating, squeezing action between rollers 10 and 12 at their tangent point at ink metering nip N. Ink storage roller 82 splits film 104*a* and receives a film 104' which is added to film 104*a* again to further assure smooth uniform thickness of film 104 on transfer roller 10.

The film of ink 104 rides on the surface of roller 10 and comes in contact with the film 130 of ink on form roller 90 at the tangent point or ink transfer nip 106 between transfer roller 10 and form roller 90.

At ink transfer nip 106, it will be observed that transfer roller 10 is impressed into the resilient surface of form roller 90 and that the film of ink 104 has an outer surface 108, contacting ink film 130, and an inner surface 110 adhering to the surface of roller 10. The outer surface 108 of film 104 and the outer surface 131 of the film of ink 130 on form roller 90 are urged together to create a hydraulic connection between roller 10 and 90 as they rotate in close relationship, but there is no physical contact between the roller surfaces.

It is an important fact to note that the relatively thick film of ink 104 permits rollers 10 and 90 to be rotated at different surface speeds as will be hereinafter explained. Preferably, the form roller 90, which is normally rotated at the same surface speed as the printing plate 112, and press driven, is rotated at a greater surface speed than the surface speed of roller 10. By regulating the differential surface speed between transfer roller 10 and applicator roller 90 the amount of ink applied to the plate 112 may be regulated.

Within limits, as will be hereinafter more fully explained, if the surface speed of transfer roller 10 is increased the ink film 104 is presented at the ink transfer nip 106 at a faster rate and more ink is transferred by the surface of roller 90 to lithographic printing plate 112, and the opposite is true, if the surface speed of roller 10 is decreased.

The film of ink 104, existent between adjacent surfaces of rollers 10 and 90, permits rollers 10 and 90 to be rotated at different surface speeds in sliding relationship, because the film of ink 104 actually provides lubrication which permits slippage between adjacent surfaces of rollers 10 and 90 without frictional deterioration. By reason of the slippage between rollers 10 and 90, the ink film 104 is calendared, smoothed out, metered and distributed by shearing the ink between adjacent surfaces of roller 10 and the ink film 130 on form roller 90, to create ink film 100. The thickness of ink film 100 is controlled by pressure between metering roller 12 and transfer roller 10 and the speed of transfer roller 10.

Transfer roller 10 preferably is driven at a surface speed which is within a range of for example, several hundred feet per minute slower than the surface speed of form roller 90. For example, if a printing press has paper travelling therethrough at a surface speed of 1200 feet per minute the surfaces of printing plate 112 and form roller 90 will ordinarily have surface speeds of 1200 feet per minute. The surface of transfer roller 10 would preferably rotate at a surface speed in a range between 50 feet per minute and 100 feet per minute, which is in a range between 4.17 and 8.33 per cent of the surface speed of the form roller.

Ink films 104 and 130 will be combined at ink transfer nip 106 and will split when sheared as rollers 10 and 90 rotate away from ink transfer nip 106. The fresh film 100 of ink adheres to the surface of form roller 90. Ink rejected by form roller 90 forms a feedback film 116 of ink which may be slightly irregular which adheres to the surface of the transfer roller 10 and is conveyed back to the bead 102 of ink adjacent ink metering nip N to be remetered. Feedback film 116 is not uniform because the starved areas on form roller 90, from which ink was removed by image areas on the plate 112, removed different quantities of ink from film 104 in order to remeter film 128 on form roller 90. Film 128 has starved areas 128' from ink removed by image areas 122 on plate 112, thus rendering film 128 irregular.

As the film 100 of ink on the surface of form roller 90 moves from ink metering nip 106 adjacent transfer roller 10, the film 100 is substantially uniform as non-uniform film 130 is combined with the uniform film 104 carried on transfer roller 10. Film 130 accepts ink from film 104 in the starved or depleted areas 128'. The transfer roller 10 is caused to rotate at a speed which satisfies the need for ink by form roller 90 by overriding clutch 66. The depleted portion or feedback film 116 is returned to the abundant or excess supply of ink at bead 102 between metering roller 12 and transfer roller 10 to replenish the ink film 104.

It has already been explained that the ink film 130 is smoothed out, distributed, metered, and regulated at the ink transfer nip 106 between transfer roller 10 and form roller 90. Material conditioning roller 86 splits film 100, taking on a film 100' to produce a matte finish on ink film **100*a*. Any irregularities or streaks in film 100 will be spread and equalized to form film 100*a*** of very uniform thickness.

The interface tension between the outer surface of the less viscous dampening fluid film 204, by reason of molecular attraction between the surface of the more viscous ink film **100*a*, causes a portion 216 of the smooth and regulated film 204 of dampening fluid to be added to the surface of ink film 100*a*, which in turn is transferred to the plate at the tangent point between the plate 112 and form roller 90 at inking nip 120**.

The lithographic printing plate 112 has hydrophillic, or water linking, non-image areas 121 and oleophillic, or ink receptive, image areas 122 formed on the surface thereof. If printing plate 112 is provided with raised image areas, the dampener 200 would not be required to prevent transfer of ink to non-image areas.

At the nip 120 between applicator roller 90 and printing plate 112, the ink film 100 is split, forming thin films 125 of ink and water over oleophillic surfaces 122 on the printing plate. The layer 216 of dampening fluid, if dampening fluid is employed, is carried on and in the film 100 of ink and is also distributed to form a thin film 226 of dampening fluid over hydrophillic areas 121 of the printing plate.

No appreciable amount of dampening fluid remains on the surface of form roller 90 which is moving away from the nip 120, but such dampening fluid as does remain thereon is transferred with the ink film 128 to the ink film **130*a* on the ink storage roller 94** where the dampening fluid can be dissipated and/or evaporated to such an extent as to be of no consequence in the inking system.

Ink of film 128 remaining on form roller 90 is combined with film **130*a* on ink storage roller 94 and split and collected on roller 94. Ink on roller 94 is added to depleted areas 128' in film 128 thus reducing the effect of ghosted and areas in film 128 by forming a more uniform film 130 before re-entering nip 106**.

The layer of dampening fluid 216 is applied in substantially the same manner. An excess of dampening fluid 201 is supplied to bead 202 to form a film 204 of dampening fluid which is applied to ink film **100*a* on form roller 90 at nip 106*a*. The film 217 of dampening fluid is returned to bead 202** to be re-metered at nip Na.

From the foregoing it should be readily apparent that the improved apparatus for applying ink to printing systems offers control of metering at ink metering nip N to provide a film 104 of ink of precisely controlled thickness by adjusting pressure between transfer roller 10 and metering roller 12 and further by controlling surface speeds of the rollers relative to each other. The rate at which the metered film 104 of ink is offered to film 130 of ink on form roller 90 at ink transfer nip N and also the hydraulic force for obtaining the desired film split is controlled.

To eliminate conditions which could cause accumulation of ink rendering it impossible to form a film 104 of precisely controlled thickness the specific roller arrangement provides for elimination of ink which is fedback in the form of ink film 116 on transfer roller 10 moving away from the ink transfer nip 106. Thus, the effect of the unused depleted film of ink not accepted by form roller 90 is eliminated from the inking system by returning film 116 to the flooded ink metering nip N and is not left to accumulate on transfer roller 10 as in prior art devices.

While a preferred embodiment of the invention has been hereinbefore described and illustrated in the attached drawings it should be appreciated that other and further forms of the apparatus can be devised without departing from the basic concept thereof.

It should further be appreciated that either the transfer roller 10 or metering roller 12 could be geared to the press drive, or driven by an independent drive means, for establishing the conditions hereinbefore described for a specified speed range.

It should be appreciated that transfer roller 10 may be oscillated laterally along its axis to further smooth ink films 130 and 100.

Having described my invention, I claim:

1. Inker apparatus for selectively and uniformly applying a film of fluid newsprint type ink to a printing plate comprising: an ink metering means; an ink transfer roller having an oleophilic ink receptive surface; a form roller engaging the printing plate, said form roller having an ink receptive surface urged into pressure relation with said ink transfer roller to form an ink transfer nip; means supporting said ink metering means and said ink transfer roller in pressure relationship to form an ink metering nip between adjacent surfaces of the ink metering means and the ink transfer roller; speed control means secured to control the surface speed of said ink transfer roller relative to the surface speed of said form roller to maintain the surface speed of the transfer roller less than the surface speed of said form roller; means to supply an excess of ink to said ink metering nip to replenish ink on the surface of the ink transfer roller which is moving from the ink transfer nip to said ink metering nip; and an ink storage vibrator roller supported in rotative contact with the surface of a film of ink on the form roller surface which has just moved from the printing plate to remove excess ink from portions of the surface of the form roller and to add the ink to depleted areas on the surface of the form roller which is moving toward said ink transfer nip.

2. Inker apparatus according to claim 1, said speed control means comprising: brake means associated with said transfer roller to maintain the surface speed of the transfer roller less than 8.33 percent of the surface speed of said form roller.

3. Inker apparatus according to claim 2 wherein said ink metering means comprises: an ink metering roller having an oleophilic surface formed thereon; and means urging said oleophilic surface of the ink metering roller into pressure indented relationship with said ink transfer roller.

4. Inker apparatus according to claim 1 with the addition of: a material conditioning roller supported in rotative contact with the film of ink on the surface of said form roller, said material conditioning roller being adapted to produce a matte finish on said film of ink which is moving from said ink transfer nip.

5. Inker apparatus according to claim 4 with the addition of: a hydrophilic roller adapted to apply a uniform film of dampening fluid on the surface of the film of ink on the surface of the form roller which has been contacted by said conditioning roller; means rotatably supporting said hydrophilic roller in pressure indented relationship with said form roller; dampening fluid metering means in pressure relationship with said hydrophilic roller; and means to supply dampening fluid to said hydrophilic roller such that the dampening fluid metering means produces a smooth, uniform, continuous film of dampening fluid on the surface of the hydrophilic roller.

6. Inker apparatus according to claim 5 wherein the dampening fluid metering means comprises a metering roller and means urging said metering roller into pressure indented relationship with said hydrophilic roller.

7. Inker apparatus according to claim 1, said speed control means comprising: variable speed drive means connected to said transfer roller; and brake means connected to said transfer roller, said variable speed drive means and said brake means being adapted to maintain the surface speed of the transfer roller in a range of 4.17 to 8.33 percent of the surface speed of said form roller.

8. A method of metering a thin film of liquid newsprint type ink onto a printing plate comprising the steps of: moving an irregular film of ink left on a form roller after applying ink to the printing plate through a nip between the form roller and a vibrator roller to replenish ink depleted areas in the irregular film with ink removed by the vibrator roller from heavily inked areas on the form roller; depositing an excess of fluid newsprint type ink onto a transfer roller surface; rotating the excess of newsprint type ink through an ink metering nip to form a film of ink of controlled thickness; rotating the film of ink of controlled thickness into engagement with the surface of the form roller to form a film of ink on the form roller; slipping the transfer roller relative to the form roller such that a thin, continuous film of ink is produced on said form roller; rotating a material conditioning roller on the surface of the film of ink on the form roller to produce a matte finish on said film of ink; and applying a braking force to said transfer roller to maintain the surface speed of the transfer roller less than the surface speed of the form roller.

9. A newspaper printing press comprising: a pair of side frames; a plate cylinder rotatably secured between said side frames; a lithographic printing plate on said plate cylinder; a form roller having a resilient cover urged into pressure indented relation with said printing plate; an ink metering roller rotatably secured between said side frames; an ink transfer roller urged into pressure indented relation with said form roller to form an ink transfer nip and with said ink metering roller to form an ink metering nip; means to apply ink to the surface of the ink metering roller to maintain an excess of ink at said ink metering nip; a dampening fluid metering roller rotatably secured between said side frames; a dampening fluid transfer roller having a hydrophilic surface urged into pressure indented relation with said form roller to form a dampening fluid transfer nip and with said dampening fluid metering roller to form a dampening fluid metering nip; means to apply dampening fluid to the surface of said dampening fluid metering roller to maintain an excess of dampening fluid at said dampening fluid metering nip; means to drive said form roller such that the surface speed of the form roller is substantially equal to the surface speed of the printing plate; an ink storage vibrator roller in rotative contact with ink on the form roller to move excess ink remaining on the form roller after engaging the printing plate to areas which are depleted of ink on the form roller before movement to said ink transfer nip; speed control means maintaining the surface speed of the ink transfer roller less than 8.33 percent of the surface speed of the form roller to meter ink onto the form roller at the ink transfer nip; and a material conditioning roller in rotative contact with the ink on the form roller moving from the ink transfer nip to the dampening fluid transfer nip.

10. A method of inking a printing plate in a newspaper printing press comprising the steps of: depositing an excess of ink on an ink transfer roller surface; moving a portion of the ink through an ink metering nip between the transfer roller and an ink metering roller to maintain a flooded metering nip and to form a film of controlled thickness on the transfer roller; urging the film of controlled thickness on the transfer roller into pressure relation with a form roller to form an ink transfer nip; rotating the ink transfer roller at a surface speed which is several hundred feet per minute slower than the surface speed of the form roller to form a thin metered ink film on the form roller at the ink transfer nip; moving the thin metered ink film through a nip between the form roller and a material conditioning roller to form a matte finish on the thin metered ink film on the form roller; moving the ink film having a matte finish into engagement with a printing plate to transfer a portion of the ink to the printing plate; and moving the ink remaining on the form roller after contacting the printing plate through a nip between the form roller and a vibrating ink storage roller to redistribute the ink remaining on the form roller before applying the ink to the surface of the form roller at the ink transfer nip.

11. Inker apparatus for selectively and uniformly applying a film of fluid newsprint type ink to a printing plate comprising: an ink metering means; an ink transfer roller having a oleophilic ink receptive surface; a form roller having an ink receptive surface adapted to be urged into pressure relation with said ink transfer roller to form an ink transfer nip; means supporting said ink metering means and said ink transfer roller in pressure indented relationship to form an ink metering nip between adjacent surfaces of the ink metering means and the ink transfer roller; speed control means secured to control the surface speed of said ink transfer roller relative to the surface speed of said form roller; means to supply ink to said ink metering nip to produce a smooth, uniform and continuous film of ink on the surface of said ink transfer roller and to replenish ink on the surface of the ink transfer roller which is moving from the ink transfer nip to said ink metering nip; an ink storage roller having an oleophilic surface; and means supporting said ink storage roller in pressure indented relation with said ink transfer roller, said ink storage roller adapted to remove excess ink and replenish the excess ink on the surface of the ink transfer roller prior to the ink film moving to said form roller.

* * * * *

UNITED STATES PATENT AND TRADEMARK OFFICE

CERTIFICATE OF CORRECTION

PATENT NO. : 4,237,785

DATED : December 9, 1980

INVENTOR(S) : Harold P. Dahlgren

It is certified that error appears in the above-identified patent and that said Letters Patent is hereby corrected as shown below:

On the title page, item [76] Inventor: should read --Harold P. Dahlgren--.

Signed and Sealed this

*Third* Day of *September 1985*

[SEAL]

*Attest:*

DONALD J. QUIGG

*Attesting Officer* *Acting Commissioner of Patents and Trademarks - Designate*